United States Patent [19]

Albrecht et al.

[11] Patent Number: 4,955,153

[45] Date of Patent: Sep. 11, 1990

[54] DISPLAY SIGN HOLDER AND DISPLAY SIGN THEREFOR

[75] Inventors: Leonard N. Albrecht, Irvine; Steven R. Burke, Huntington Beach, both of Calif.

[73] Assignees: Bruce G. McLeod, Anaheim; Allan R. Fowler, Palm Desert, both of Calif. ; a part interest

[21] Appl. No.: 338,469

[22] Filed: Apr. 14, 1989

Related U.S. Application Data

[63] Continuation of Ser. No. 73,925, Jul. 15, 1987, abandoned.

[51] Int. Cl.[5] ..... G09F 3/18

[52] U.S. Cl. ..... 40/661; 40/644; 40/649; 40/591; 40/593; 40/490

[58] Field of Search ..... 40/152, 591, 593, 594, 40/595, 643, 644, 642, 611, 649, 491, 490, 489, 488, 487, 661, 159, 152.1

[56] References Cited

U.S. PATENT DOCUMENTS

| | | | |
|---|---|---|---|
| 1,729,961 | 10/1929 | Partridge | 40/10 D |
| 2,093,598 | 9/1937 | Clark | 40/10 A |
| 2,181,976 | 12/1939 | Lotz | 40/649 |
| 2,619,867 | 12/1952 | Frisch | 40/490 |
| 3,698,111 | 10/1972 | Smith | 40/642 |
| 4,184,276 | 1/1980 | Hernandez | 40/10 A |
| 4,305,216 | 12/1981 | Skelton | 40/644 |
| 4,413,434 | 11/1983 | Rupert et al. | 40/661 |

FOREIGN PATENT DOCUMENTS

| | | | |
|---|---|---|---|
| 2122012 | 1/1984 | United Kingdom | 40/10 B |

*Primary Examiner*—James R. Brittain
*Assistant Examiner*—J. Hakomaki
*Attorney, Agent, or Firm*—Allan R. Fowler

[57] ABSTRACT

Disclosed is a display sign holder in the form of a semi-rigid rectangular sheet of optically clear plastic having elongated flat spacing structures extending along its top and bottom margin areas on one side so as to space the plastic sheet from a supporting surface and guide the longitudinal insertion and removal of an elongated display sign therebetween. The spacing structures are flat strips printed with ink on one or both sides to permanently display marginal information or design, and relatively thin transparent adhesive layers are disposed on both sides of the strips to adhere them to the plastic sheet and to the supporting surface.

9 Claims, 2 Drawing Sheets

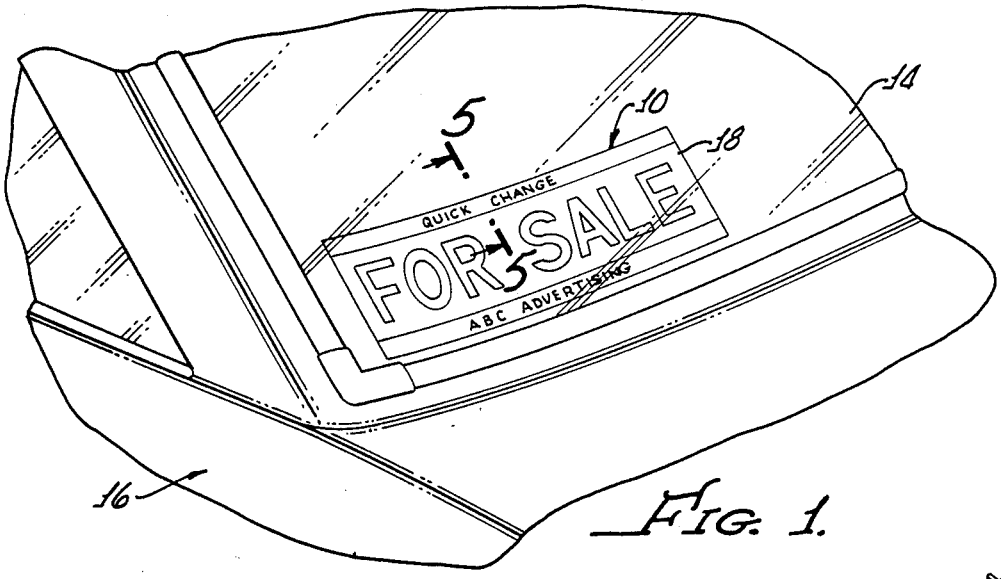
FIG. 1.
FIG. 2.
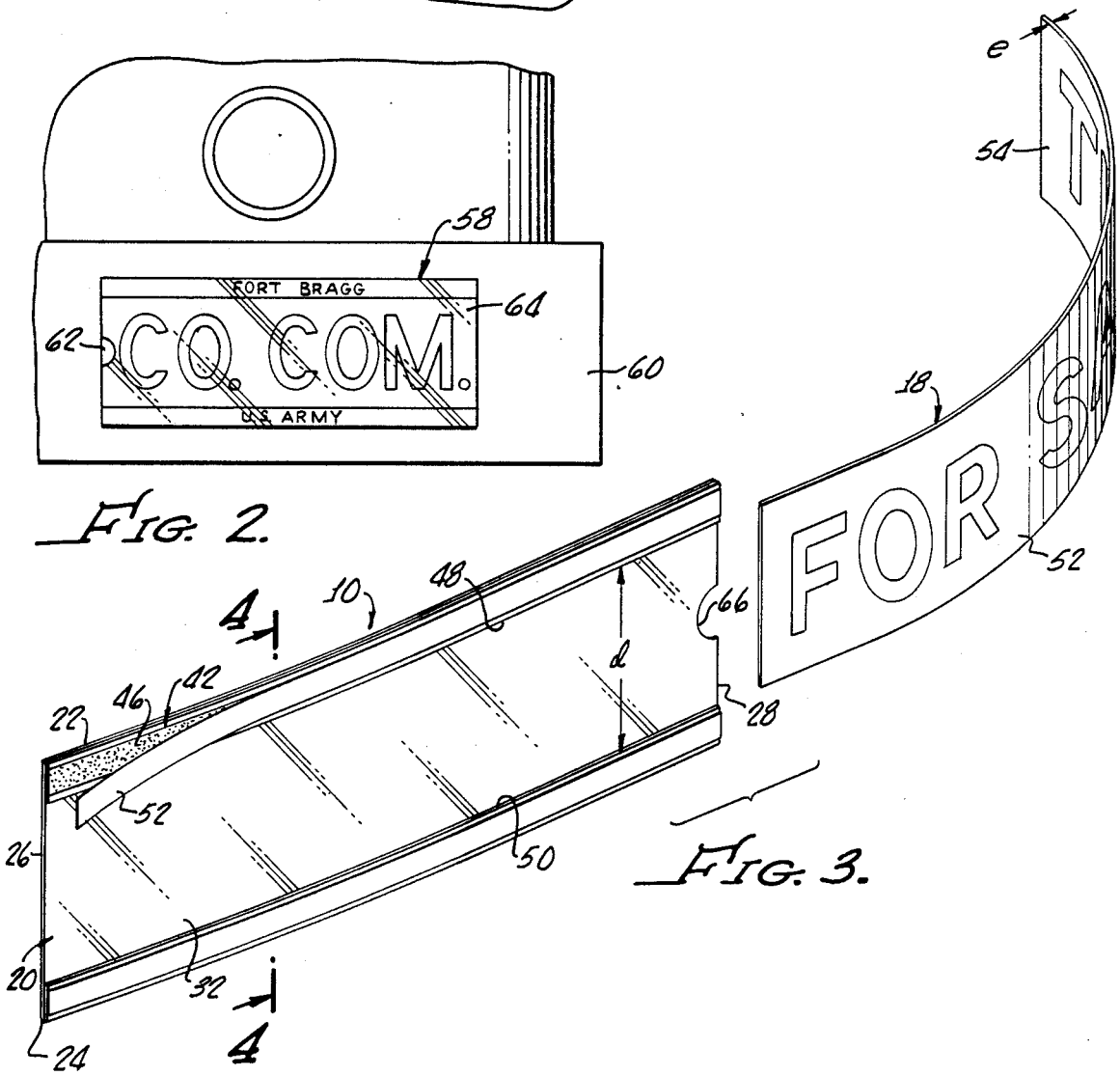
FIG. 3.

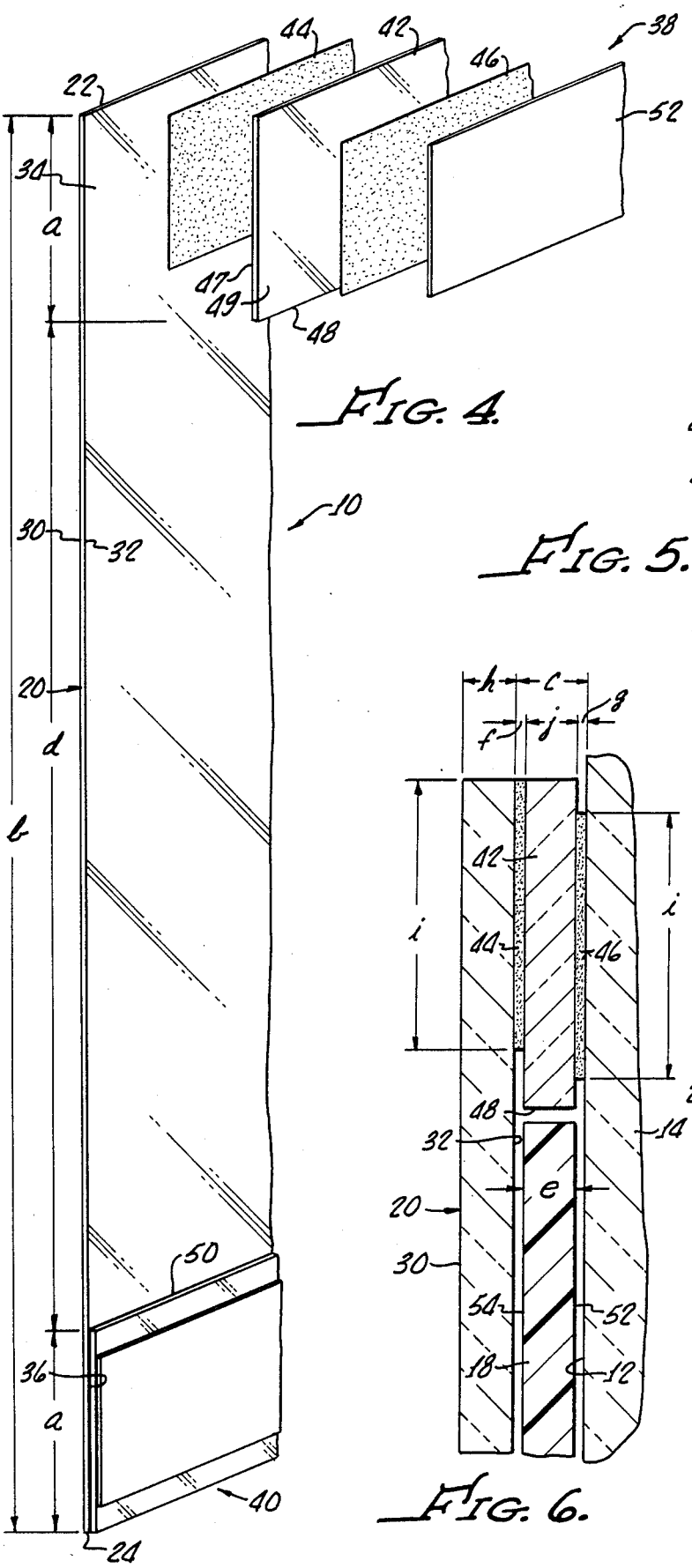
FIG. 4.
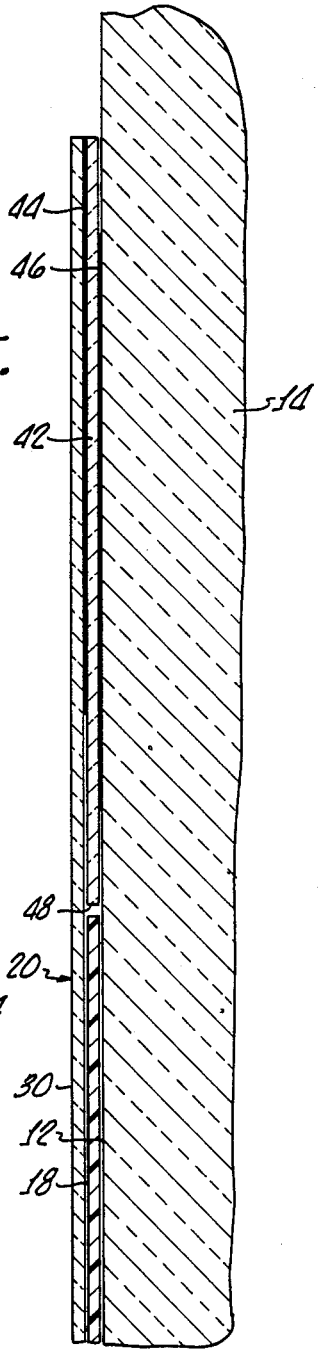
FIG. 5.
FIG. 6.

DISPLAY SIGN HOLDER AND DISPLAY SIGN THEREFOR

This application is a continuation of application Ser. No. 073,925, filed July 15, 1987, now abandoned.

This invention relates to display sign holders and display signs cooperative therewith, and has particular reference to a sleeve-type holder adapted to conform and adhere to a planar or gently curved supporting surface for holding and displaying signs removably inserted between the holder and the supporting surface.

Display signs frequently take the form of elongated rectangular sheets having ample surface area to convey a design or message at a reasonable distance of 20 to 30 feet or beyond, such as in the case of an automobile bumper sticker or rear window sticker Such display signs typically have an adhesive coating on one side thereof for directly applying the sign itself to a supporting surface, and therefore are difficult to remove or change.

There has unquestionably existed for some long time many different holders into which signs may be inserted and removed, but as indicated by the persistance of the conventional bumper stickers and window stickers, a display sign holder having a sufficient structural integrity which is inexpensive and readily adaptable to such purposes has not yet been achieved to a sufficient degree to obtain general public acceptance.

In accordance with the present invention, there is provided an improved display sign holder adapted to conform and adhere to a planar or gently curved supporting surface for holding and displaying signs removably inserted between the holder and the supporting surface, and which is of inexpensive construction while having significant structural integrity and adaptability to many uses.

A display sign holder constructed in accordance with the present invention includes a semi-rigid flat sheet of plastic material having a substantial thickness and an elongated rectangular configuration, with top and bottom elongated edges extending generally parallel along the length thereof and with opposite end edges extending transverse to the length thereof. Upper and lower elongated flat spacing structures are defined along the full length of the surface area margins of the sheet respectively adjacent the top and bottom edges on one side of the sheet. The spacing structures each have a substantial thickness, to thereby space the marginal areas of the sheet, hence nominally the sheet portion therebetween, from any supporting surface against which said spacing structures are placed. Each spacing structure has a layer of adhesive extending along the exposed surface thereof, such adhesive being covered by an elongated strip of protective material which may be peeled off and discarded to expose the adhesive layers in order to adhere the holder to a supporting surface.

The spacing structures define a wide shallow open channel on one side of the sheet having a uniform depth corresponding approximately to the thickness of said flat spacing structures for receiving the insertion of an elongated rectangular semi-rigid display sign of approximately the same dimension as the channel, with the thickness of the display sign being not substantially in excess of the combined thickness of either spacing structure and any adhesive layers applied thereto, and being large compared to the thickness of any individual adhesive layer.

Also, in accordance with the preferred embodiment of the invention, each spacing structure comprises an elongated flat strip of material having a width small compared to that of the holder sheet, and an adhesive layer disposed on the corresponding surface area margin of the sheet and adhering the flat strip thereto. Preferably the flat strip is of the same material and thickness as the holder sheet, and the strips have elongated inward edges extending along the full length of the holder, such inward edges being parallel, smooth and straight and each defining an elongate narrow surface disposed in a plane approximately at right angles to the sheet so as to define an elongated open channel thereon of generally rectangular cross-section for receiving and guiding the insert of a display sign.

Further, in accordance with the preferred embodiment of the invention, the semi-rigid plastic sheet is optically clear, thereby adapting the display holder for placement on an opaque surface, such as an automobile bumper so as to hold and protect a display sign for viewing exclusively from one side thereof, and for placement on the interior or exterior of a transparent window, such as the interior or exterior of a glass automobile window, for viewing the inserted display sign from one or both sides thereof. Preferably, for maximum adaptability, the holder sheet as well as the spacing structures and adhesive layers all are of optically clear material, with the spacing structures having sufficient width to permanently display marginal information or design, which may be printed on one or both sides of the flat strips, or on one or both of the above mentioned marginal surface areas of the sheet, under an overlying adhesive layer.

These and other significant features of the present invention will be more clearly understood by reference to the following description of preferred embodiments of the invention, taken in conjunction with the accompanying drawings, in which:

FIG. 1 is a fragmentary perspective view illustrating a display sign holder adhered to the inside curved surface of the rear glass window of an automobile, with display card inserted;

FIG. 2 is a fragmentary elevation illustrating the same display sign holder applied to the front bumper of a vehicle, but with different permanent marginal printing and a different display sign removably inserted therein;

FIG. 3 is a perspective, partially exploded view of the display sign holder and display sign of FIG. 1;

FIG. 4 is a fragmented perspective view, partially exploded, and taken generally along line 4—4 of FIG. 3;

FIG. 5 is a fragmentary cross-sectional view taken along line 5—5 of FIG. 1; and, FIG. 6 is a view similar to FIG. 5, but with exaggerated dimensions for purposes of clarity and description.

Referring now to FIGS. 1, 3, and 4 to 6, a display sign holder 10 is provided which is adapted to conform and adhere to a planar or gently curved supporting surface, such as the gently curved interior surface 12 of the rear glass window 14 of an automobile 16. The holder 10 serves to hold and display a sign 18 removably inserted between the holder 10 and the supporting surface 12.

The display sign holder 10 includes a semi-rigid sheet of plastic material 20 having an elongated rectangular configuration, with a top edge 22 and a bottom edge 24 extending parallel along the length thereof, and with opposite end edges 26, 28 extending transverse to the length thereof.

The holder sheet 20 has opposite sides 30, 32, and has upper and lower surface area margins 34, 36 generally defined by the dimension "a" extending along the length thereof respectfully adjacent the top and bottom edges 22, 24 thereof on one side 32 of the sheet overlying which are upper and lower spacing structures 38, 40. But for any printing thereon, the upper and lower spacing structures are identical.

As typically shown for the upper spacing structure 38, each spacing structure comprises an elongated flat strip 42 of material having a width "a" which is small compared to the width "d" of that portion of the sheet 20, extending between the upper and lower spacing structures a first adhesive layer 44 disposed on the surface area margin 34 of the sheet and adhering the inner surface 47 of the flat strip 42 thereto, and a second adhesive layer 46 disposed on the outer or exposed base surface 49 of the flat strip 42. Each supporting structure is of substantial thickness measured by the combined thickness of the typical flat strip 42 and adhesive layers 44, 46, as depicted by the dimension "c".

The flat strips included in the upper and lower supporting structures respectfully have an inward facing edge surface 48, 50 extending along the length thereof, such inward edge surfaces 48, 50 being generally parallel, smooth and straight and each defining, on one side 32 of the sheet 20 in conjunction with the sheet portion (indicated by the dimension "d") of the holder sheet extending therebetween, a shallow channel for receiving the display sign 18. The inward edge surfaces 48, 50 are elongate narrow surfaces each disposed in a plane approximately at right angles to said side 32 of the sheet, thereby defining the elongated open channel rectangular in cross-section for facilitating and guiding the insertion of the display sign 18.

Also, as shown typically by the upper supporting structure 38, the second or outer adhesive layer 46 is covered by an elongated strip of protective material 52, preferably a waxed paper, which is easily removed manually by peeling it back and discarding it to expose the adhesive layer in order to adhere the holder to the supporting surface 12.

As can be seen from the drawings, the display sign 18 has an elongated rectangular configuration of approximately the same dimension as the channel defined by the edge surfaces 48, 50 and intermediate sheet portion therebetween as represented by the dimension "d". The display sign has a thickness "e" which is very considerably in excess of the thickness "f" and "g" of the first and second adhesive layers 44, 46, and preferably is only slightly less than the combined thickness "c" of each supporting structure, which as can be seen space the holder sheet surface 32 from the supporting surface 12 by such combined thickness.

The semi-rigid sheet 20 of the holder, for example, may have a length as represented by one of its longitudinal edges 22 of about 10 inches and a typical width "b" as represented by its end edge 26 of about 3½ inches, with the width of the typical elongated spacing structure being about 0.5 inches, as represented by the dimension "a". Preferably the sheet 20 is of rigid polyvinyl chloride plastic, either extruded or carded, optically clear and with a thickness "h" of between about 0.007 and 0.012", the preferred thickness being approximately 0.010 inches. Typically, the thickness "f" and "g" of the first and second adhesive layers is 0.02" each, and the typical flat strip 42 has a thickness "j" the same as the thickness "h" of the holder sheet 20, whereby the total combined thickness "c" of the typical spacing structure 38 is approximately 0.014". The width "i" of the first and second adhesive layers is preferably about ⅜", slightly less than that of the flat strip 42, so that adhesive does not flow into the channel area and interfere with the geometry thereof. The flat strip 42 is preferably made from the same semi-rigid sheet stock as that for the sheet 20.

Preferably, the first and second layers of adhesive are also optically clear, as is the case with the sheet 20 and the flat strip 42. The adhesive used is 3M 9460 adhesive available from Minnesota Mining and Manufacturing Company.

Permanent inking to display a marginal message or design can be applied, in accordance with the use to be made of the display holder to either side of the flat strips, typically shown at 47, 49 of the typical flat strip 42, or to either of the marginal surface areas as typified at 34 of the sheet 20.

Also, the display sign 18 may have different designs or messages applied to its opposite surfaces 52, 54, in case, for example, one wants to reverse the display sign to display a different message or in order to have it read differently from the interior as opposed to the exterior of a vehicle window. Any permanent displays inked in the marginal areas of the holder will, in any case, reside in whole or major part under an adhesive layer which, depending upon the surface selected for inking may require that any components of the holder structure intervening between the inked display and the intended viewing position be optically clear.

As shown in FIG. 2 a similar display holder 58 is applied to the front bumper surface 60 of a vehicle and has a display sign 62 inserted therein between the protective optically clear holder sheet 64 and the supporting surface 60 of the bumper. In this case, the display holder and display sign is viewed only from one side, and the protective holder sheet 62 and underlying supporting structures (not shown in FIG. 2) perform the function of protecting the display sign from the elements as well as holding it in place.

As seen in FIG. 3, one end edge 28 of the holder sheet 20 may be provided with a cutout portion 66 to facilitate removal of a sign already inserted.

The materials and dimensions above discussed in regard to the display sign holder are found to facilitate inexpensive manufacture by conventional methods while achieving the semi-rigid and optically clear properties described.

The above references to "semi-rigid" in describing the holder sheet 20 and the display sign 18, considering the typical dimensions given, are intended to define in the case of the sheet 20 a structural member of significant self-supporting structural integrity, whereby to adequately protect and hold a display sign under changing environmental conditions as well as to maintain optical clarity and not to tear or wrinkle or otherwise significantly distort upon the insertion of a display sign between the sheet and a supporting surface. The preferred dimensions for the sign and its description as "semi-rigid", cooperate with the holder structure for permitting the ready insertion and removal of the sign from the holder, with the holder being able to conform to a gently curved supporting surface.

By reference to "optical clarity" as set forth above, the intention is not to refer to perfect optical clarity but to refer to the transparency of the structure. In the case of the plastic sheet 20, optical clarity also refers to the sheet having sufficient structural integrity to maintain transparency without significant distortion. Such semi-rigid sheet structure is obtained by using a rigid type plastic material, as opposed to a soft plastic material which contains plasticisers.

What is claimed is:

1. A semi-rigid, sleeve-type display sign holder adapted to conform and adhere to a planar or gently curved supporting surface for holding and displaying an elongated display sign removably inserted longitudinally between said holder and the supporting surface, said display sign holder comprising:

(a) a semi-rigid substantially flat sheet of optically clear plastic material of substantial thickness, said sheet having an elongated rectangular configuration, with top and bottom elongated edges extending generally parallel along the length thereof and with opposite ends edges extending transverse to the length thereof; and, said sheet also having opposite sides and upper and lower marginal areas extending longitudinally for the full length of said sheet along one side thereof respectively adjacent said top and bottom edges;

(b) means defining substantially flat, elongated upper and lower spacing structures extending respectively along said upper and lower marginal areas for the full length thereof on said one side of the sheet, said spacing structures each having an outer base surface and having a substantial thickness corresponding approximately to the thickness of said sheet, and thereby so spacing the sheet portion therebetween from any supporting surface against which the outer base surfaces of said spacing structures are placed and defining an elongated open channel of uniform depth corresponding approximately to the thickness of said flat spacing structures into which an elongated display sign may be freely inserted and retained against said supporting surface;

(c) an upper and lower layer of adhesive extending respectively along the outer base surface of the upper and lower spacing structure for adhering the holder to a supporting surface; and (d) upper and lower elongated strips of protective material respectively covering said upper and lower adhesive layers, said protective strips being manually removable to expose the adhesive layers in order to adhere the holder to a supporting surface.

2. The display sign holder of claim 1 wherein the upper and lower spacing structures each have an elongated inward edge extending along the full length thereof, such inward edges being generally parallel, smooth and straight and each defining an elongate narrow surface disposed in a plane approximately at right angles to said side of the sheet so as to define said elongated open channel as generally rectangular in cross-section on said side of the sheet for receiving and guiding the insert of a display sign.

3. The display sign holder of claim 2, wherein each spacing structure comprises:

(a) an elongated flat strip of semi-rigid material having opposite sides respectively defining an inner surface and said outer base surface, and having a width small compared to that of the sheet;

(b) said adhesive layer disposed on the outer base surface; and, (c) an adhesive layer adhering the inner surface of the flat strip to the associated marginal area of the sheet.

4. The display sign holder of claim 1, wherein the outer base surface of at least one of said spacing structures is printed with ink to permanently display marginal information or design, and wherein said adhesive layer applied to the outer base surface of that spacing structure is optically clear and overlies said ink.

5. The display sign holder of claim 3, wherein the semi-rigid sheet and flat strips each have a thickness of between about 0.007 and 0.012 inches.

6. The display sign holder of claim 5, wherein the semi-rigid sheet is made of extruded or calendered non-plasticized polyvinylchloride.

7. The display sign holder of claim 3, wherein each flat strip is of the same material and thickness as the semi-rigid sheet.

8. The display sign holder of claim 2, in combination with a display sign therefore, said display sign comprising a semi-rigid sheet of material having an elongated rectangular configuration which approximately matches that of said open channel defined on the holder and having a display formed thereon, the display sign having a thickness which is not substantially in excess of the combined thickness of either spacing structure and any adhesive layer applied thereto, and which is substantially in excess of the thickness of any individual adhesive layer.

9. The display sign holder of claim 3, wherein the inner surface of at least one of said flat strips is printed with ink to permanently display marginal information or design, and wherein said adhesive layer adhering the inner surface of the flat strip to the associated marginal area of the sheet is optically clear and overlies said ink.

* * * * *